US009324277B2

(12) United States Patent
Yang

(10) Patent No.: US 9,324,277 B2
(45) Date of Patent: Apr. 26, 2016

(54) BACKLIGHT DRIVING CIRCUIT, LIQUID CRYSTAL DISPLAY DEVICE AND DRIVE METHOD

(71) Applicant: SHENZHEN CHINA STAR OPTOELECTRONICS TECHNOLOGY CO., LTD., Shenzhen, Guangdong (CN)

(72) Inventor: Xiang Yang, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 123 days.

(21) Appl. No.: 14/241,419

(22) PCT Filed: Jan. 22, 2014

(86) PCT No.: PCT/CN2014/071052

§ 371 (c)(1),
(2) Date: Feb. 26, 2014

(87) PCT Pub. No.: WO2015/081631

PCT Pub. Date: Jun. 11, 2015

(65) Prior Publication Data

US 2015/0161950 A1 Jun. 11, 2015

(30) Foreign Application Priority Data

Dec. 6, 2013 (CN) ..... 2013 1 0656726

(51) Int. Cl.
*G09G 3/34* (2006.01)
*G09G 3/36* (2006.01)

(52) U.S. Cl.
CPC ..... *G09G 3/3406* (2013.01); *G09G 3/3696* (2013.01); *G09G 2330/02* (2013.01)

(58) Field of Classification Search
CPC ..... G09G 3/3406; G09G 3/3696; G09G 2330/12; G09G 2330/00; H05B 41/2827
See application file for complete search history.

(56) References Cited

U.S. PATENT DOCUMENTS 7,612,505 B2 * 11/2009 Min ..... H05B 41/2827 315/247
8,022,638 B2 * 9/2011 Jang ..... H05B 41/2855 315/257
2012/0274877 A1 11/2012 Sasaki et al. ..... 349/69

FOREIGN PATENT DOCUMENTS

CN 2911728 Y 6/2007
CN 101071986 A 11/2007

(Continued)

OTHER PUBLICATIONS

International Search Report dated Sep. 24, 2014, issued to International Application No. PCT/CN2014/071052.

*Primary Examiner* — Abbas Abdulselam
(74) *Attorney, Agent, or Firm* — Stein IP, LLC

(57) ABSTRACT

The present invention provides a backlight drive circuit, and a liquid crystal display and a drive method for the same, wherein the backlight drive circuit includes: an error amplification unit configured to receive a feedback voltage from the backlight, and used for comparing the feedback voltage with a basis voltage, adjusting the amplification coefficient and the amplification speed for a comparison result based on the magnitude of the comparison result, and outputting an amplification result as a control signal; and a drive control unit configured to receive the control signal from the error amplification unit, and used for outputting, according to the control signal, a pulse width modulation dimming signal with a corresponding duty cycle to modulate a voltage signal output to the backlight from a power supply. The backlight drive circuit may be applied to driving operation for various display devises and capable of automatically adjusting response rate under different loading modes. Compared with the prior art, the backlight drive circuit has higher response rate and accordingly can improve the display performance of animating images in a display device in an indirect manner.

19 Claims, 3 Drawing Sheets

(56) References Cited

FOREIGN PATENT DOCUMENTS

| | | | |
|---|---|---|---|
| CN | 101202017 | A | 6/2008 |
| CN | 101222805 | A | 7/2008 |
| CN | 101364768 | A | 2/2009 |
| CN | 101694764 | A | 4/2010 |
| CN | 101772237 | A | 7/2010 |
| CN | 103151009 | A | 6/2013 |
| JP | H 7-184321 | A | 2/1997 |

* cited by examiner

BACKLIGHT DRIVING CIRCUIT, LIQUID CRYSTAL DISPLAY DEVICE AND DRIVE METHOD

FIELD OF THE INVENTION

The present disclosure relates to a backlight driving technology for a display device, and, in particular, to a backlight drive circuit, and a liquid crystal display device and a drive method for the same.

BACKGROUND OF THE INVENTION

In the current field of image display technology, TFT LCD (Thin Film Transistor Liquid Crystal Display) stands out owing to its excellent performances and rapidly expands in various application fields, such as mobile phones, computers, televisions, etc. In a liquid crystal display device, transmittance of the backlight is controlled by deflection of non-luminous liquid crystal molecules while under the effect of voltage, such that a function of image display is realized. In view of this, improvement of the operating performances of a backlight module has become an important developing trend in the display technology.

At present, for the mainstream manufacturers of liquid crystal display devices, a boost converter with a pulse width modulation dimming function, as shown in FIG. 1, is used as a drive circuit for the backlight like LED lamps to supply an operating voltage for the LED lamps and adjust the magnitude of the operating voltage in order to control the luminance of the LED lamps. In this circuit, a drive control unit is one of the key circuit units, and it plays a role of modulating a sawtooth-wave signal based on an input control signal to output a pulse width modulation dimming signal (referred to as PWM dimming signal for short) with a particular duty cycle. The PWM dimming signal is used for modulating a voltage signal $V_{in}$ output to the LED lamps from a power supply, and a modulated voltage signal $V_{out}$ is loaded onto the LED lamps to drive the LED lamps. Meanwhile, in order to achieve short response time and good voltage stabilizing effect, a voltage at the LED lamps is collected as a feedback voltage $V_{FB}$, and is supplied to an error amplification unit located at the pre-stage of the drive control unit. The feedback voltage $V_{FB}$ is compared with a predetermined reference voltage $V_{REF}$ at an input terminal of the error amplification unit, and the comparison result is amplified by the error amplification unit to serve as a control signal for adjusting the duty cycle of the PWM dimming signal and then supplied to the drive control unit. By mean of this, the drive control unit is controlled to output a PWM dimming signal with an appropriate duty cycle, such that adjustment to the operating voltage $V_{out}$ of the LED lamps is achieved.

Typically, the liquid crystal display device needs to be switched back and forth between different operating modes during displaying, and provides, e.g., a black pattern, a white pattern and gray scale patterns with various luminance. Thus, the LED lamps, which serve as a light source for the liquid crystal display device, also need to operate under different modes, e.g., a low loading mode when the black pattern is provided, a high loading mode when the white pattern is provided and an intermediate mode when those gray scale patterns are provided. The response rate (or response time) of above mode switching is one of the important indicators to evaluate the imaging performance of a display device.

In the prior art, in order to meet the requirements of all LED lamps in a backlight, such as luminance, error and voltage stabilization, the relevant parameters of a backlight drive circuit are typically designed in accordance with the most extreme situation, i.e., switching from the low loading mode to the high loading mode and from the high loading mode to the low loading mode, such that the backlight drive circuit and the display device thereof have relatively reasonable response rates. Such a "one-size-fits-all" design pattern, although simple and convenient, may lead to a low overall response rate due to failure of considering the intermediate modes having very small luminance scales but emerging mostly in practical use, such that the problems, such as INRUSH noise, instability of power supply system, etc. may be aroused. Accordingly, the present disclosure provides, on the basis of the prior art, a backlight drive circuit capable of adjusting response rate for different loading modes, and a liquid crystal display and a drive method using the same.

SUMMARY OF THE INVENTION

Aiming at the problems mentioned above, the present disclosure provides a backlight drive circuit capable of adjusting response rate for different loading modes, and a liquid crystal display and a drive method for the same.

The backlight drive circuit provided in the present disclosure comprises: an error amplification unit, configured to receive a feedback voltage from a backlight, and used for comparing the feedback voltage with a basis voltage, adjusting the amplification coefficient and amplification speed for the comparison result according to the magnitude of the comparison result, and outputting the amplification result as a control signal; and a drive control unit, configured to receive the control signal from the error amplification unit, and used for outputting, according to the control signal, a pulse width modulation dimming signal with a corresponding duty cycle to modulate a voltage signal output to the backlight from a power supply.

The error amplification unit includes a plurality of error amplifiers, with the comparison terminals thereof being mutually coupled to receive the feedback voltage, the reference terminals thereof receiving different reference voltages, and the output terminals thereof being mutually coupled to output the control signal, wherein the reference voltages each are in a multiple relationship with the basis voltage.

In accordance with the embodiment of the present disclosure, the error amplification unit includes error amplifiers $OP_i$, i=−N . . . +N, and N is an integer greater or equal to 1, wherein the reference voltage $V_{REFi}$ of the $i^{th}$ amplifier satisfies the following relationship with the basis voltage $V_{REF0}$:

$$V_{REFi}=(1+pxi)V_{REF0},$$

wherein p is an adjustment parameter greater than zero.

In accordance with the embodiment of the present disclosure, the adjustment parameter p is equal to 0.1.

The error amplifiers may be distributed in a mirroring manner.

The error amplifiers may be current amplifiers.

The backlight drive circuit further comprises: a reference voltage generating unit, coupled to the error amplification unit, and used for supplying the reference voltages to the error amplification unit.

In addition, the present disclosure further provides a liquid crystal display device including a display panel and a backlight module, wherein the backlight module includes the aforementioned backlight drive circuit.

In addition, further provided in the present disclosure is a backlight drive method, including: a collection step of collecting a backlight feedback voltage; a comparison step of comparing the backlight feedback voltage with a basis voltage; an amplification step of adjusting the amplification coefficient and the amplification speed for the comparison result according to the magnitude of the comparison result, and outputting the amplification result as a control signal; and an output step of outputting, according to the control signal, a pulse width modulation dimming signal with a corresponding duty cycle to modulate a voltage signal output to the backlight from a power supply.

In the amplification step above, the amplifiers in corresponding quantity with corresponding gains are triggered according to the magnitude of the comparison result, so as to amplify the comparison result with different amplification coefficients and at different amplification speeds.

In the present disclosure, as an improvement for the existing backlight drive circuit, the original error amplification unit in the backlight drive circuit is replaced by an error amplification unit capable of automatically adjusting the amplifying capability, such that the response rate can be automatically adjusted under different loading modes. Compared with the prior art, the backlight drive circuit in the present discourse has higher response rate and accordingly can improve the display performance of animating images in a display device in an indirect manner.

Other features and advantages of the present disclosure will be illustrated in the following description, and become partially apparent from the description or may be understood through implementing the present disclosure. The objects and other advantages of the present disclosure may also be realized and obtained through the structures specified in the description, claims and accompanying drawings.

DETAILED DESCRIPTION OF THE EMBODIMENTS

To provide a backlight drive circuit with different response rates under varied loading modes, a backlight drive circuit in an existing liquid crystal display device is improved in the present disclosure. An error amplification unit in the original drive circuit is modified by an error amplification unit capable of automatically adjusting amplifying capability. Specifically, the backlight drive circuit provided in the present disclosure comprises:

an error amplification unit, which is configured to receive a feedback voltage from the backlight, and is used for comparing the feedback voltage with a basis voltage, then adjusting the amplification coefficient and amplification speed for the comparison result according to the magnitude of the comparison result, and outputting the amplification result as a control signal; and a drive control unit, which is configured to receive the control signal from the error amplification unit, and is used for outputting, according to the control signal, a pulse width modulation dimming signal with a corresponding duty cycle to modulate a voltage signal output to the backlight from a power supply.

One specific embodiment of the backlight drive circuit in the present disclosure and its operation principle and achievable technical effects will be discussed in details below in conjunction with the accompanying drawings by taking a LED liquid crystal display device as an example.

Figure 1:
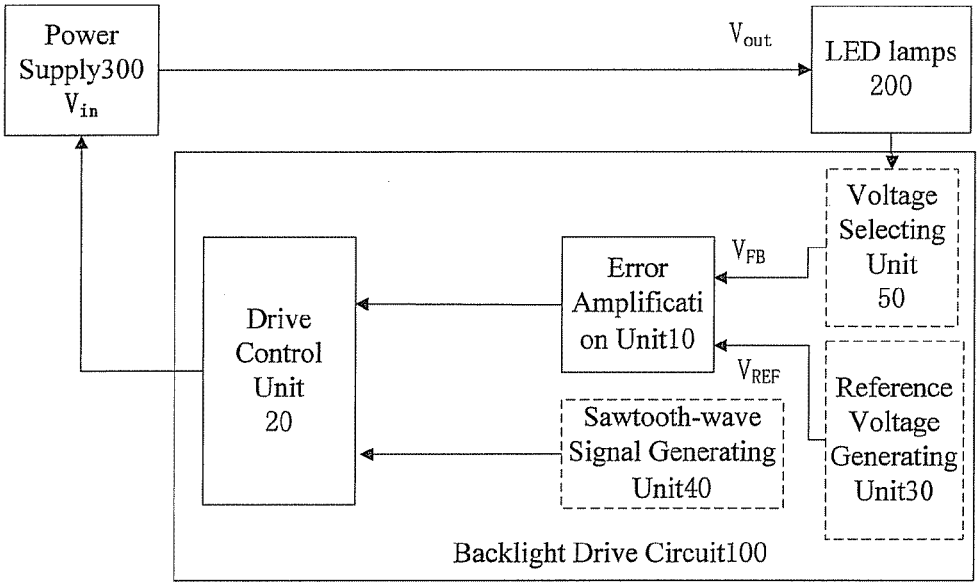
FIG. 1 is a diagram of composition structure of a backlight module in a LED liquid crystal display device in the prior art.
Figure 2:
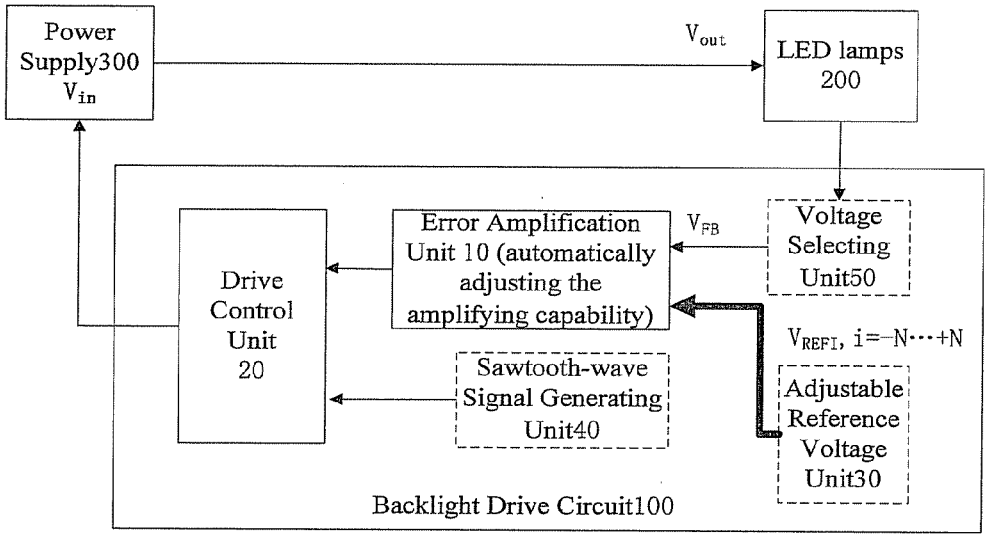
FIG. 2 is a diagram of composition structure of a backlight module in a liquid crystal display device according to one embodiment of the present disclosure.
Figure 3:
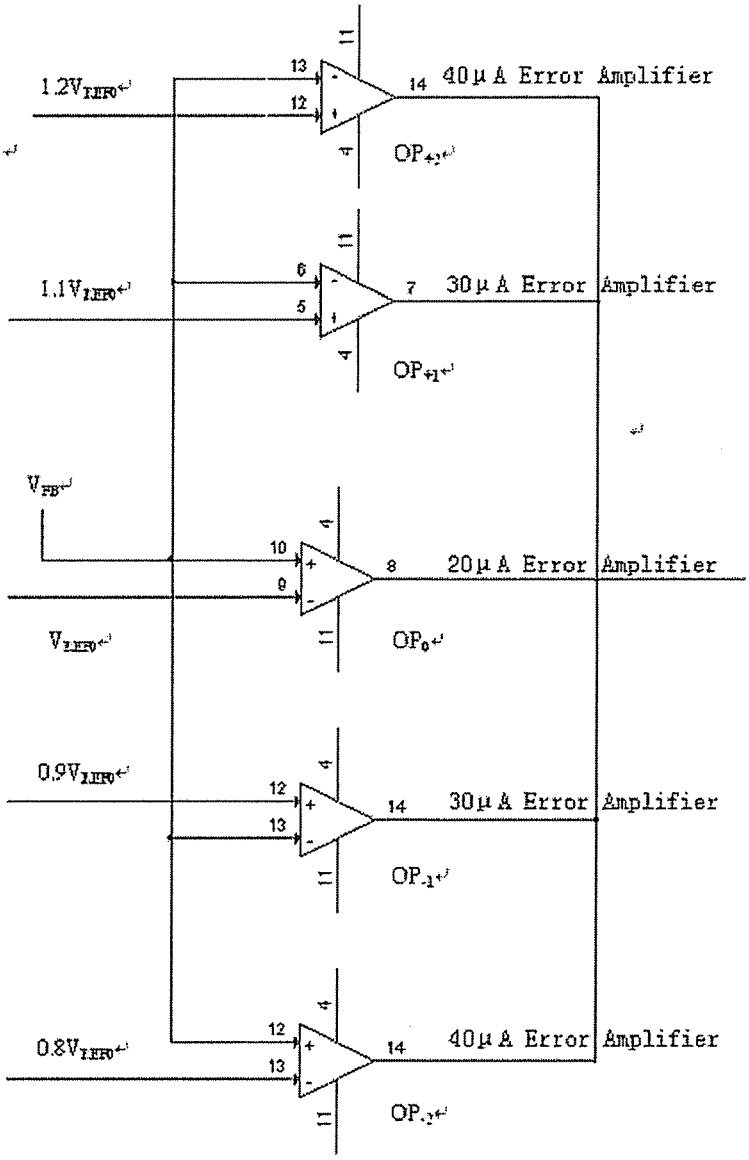
FIG. 3 is a diagram of circuit structure of an error amplification unit of a backlight drive circuit in the backlight module of FIG. 2.

As shown in FIG. 2, it is a diagram of composition structure of the backlight module of the LED liquid crystal display device according to one embodiment of the present disclosure. The backlight module includes a backlight drive circuit 100, a plurality of LED lamps 200 arranged in parallel, and a power supply 300, wherein the backlight drive circuit 100 includes an error amplification unit 10 and a drive control unit 20, wherein:

As shown in FIG. 3, the error amplification unit 10 includes 2N+1 error amplifiers, which are respectively marked as $OP_i$, i=−N . . . +N, and N is an integer greater or equal to 1. In the case, respective comparison terminals of the error amplifiers are mutually coupled to receive a feedback voltage $V_{FB}$ from the LED lamps 200, while reference terminals of the error amplifiers are used for receiving different reference voltages $V_{REFi}$, i=−N . . . +N. Output terminals of the error amplifiers are mutually coupled to output a control signal to the drive control unit 20, and amplification coefficients of respective error amplifiers are $K_i$, i=−N . . . +N.

Preferably, the aforementioned reference voltages $V_{REFi}$, (i=−N . . . +N) may be provided by a reference voltage generating unit. Firstly, a basis voltage $V_{REF0}$ is generated inside the reference voltage generating unit, and then it is diminished or amplified by different multiples, and finally the obtained results are output as the reference voltages $V_{REFi}$, (i=−N . . . +N) to supply to the corresponding error amplifiers $OP_i$, (i=−N . . . +N). Since the reference voltage generating unit pertains to the prior art, but not the key points to be disclosed in the present disclosure, it is not discussed in detail herein.

In an embodiment shown in FIG. 3, the reference voltages $V_{REFi}$, (i=−N . . . +N) satisfy the following relationship thereamong:

$$V_{REFi}=(1+pxi)V_{REF0}.$$

In the equation above, p is an adjustment parameter greater than zero, and it may be set as 0.1 in this embodiment.

In this case, inversion signal input terminals of the aforementioned error amplifiers $OP_i$, (i=−N . . . 0) serve as reference terminals to receive the corresponding reference voltages $V_{REFi}$, (i=−N . . . 0), while the inphase signal input terminals of the respective error amplifiers $OP_i$, (i=1 . . . N) serve as reference terminals to receive the corresponding reference voltages $V_{REFi}$, (i=1 . . . N).

And further, the error amplifiers $OP_i$, (i=−N . . . −1) may be the same elements corresponding to the error amplifiers $OP_1$, (i=1 . . . N), and this may form a circuit structure of vertical mirror symmetry with the error amplifier $OP_0$ as a center. In this embodiment, $OP_{0+}$ is an error amplifier using 20 μA, $OP_{-1}$ and $OP_{+1}$ are error amplifiers using 30 μA, and $OP_{-2}$ and $OP_{+2}$ are error amplifiers using 40 μA . . . . And so forth, $OP_{-N}$ and $OP_{+N}$ are error amplifiers using (N+2)×20 μA.

The operation principle of the aforementioned circuit is as follows:

In the case of stable load, $V_{FB}$ is stable and $V_{FB}=V_{REF0}$, and only the error amplifier $OP_0$ with an amplification coefficient $K_0$ is triggered to output a corresponding current $I_0$, which is supplied to the drive control unit 20 as the control signal.

In the case of instable load, $V_{FB}$ increases or decreases instantaneously, wherein:

If $0.8V_{REF0} \leq V_{FB} < 0.9V_{REF0}$, the error amplifiers $OP_0$ with an amplification coefficient $K_0$, $OP_{-1}$ with an amplification coefficient $K_{-1}$ and $OP_{-2}$ with an amplification coefficient $K_{-2}$ are triggered simultaneously to output corresponding currents $I_0$, $L_1$ and $L_2$ respectively, and then the sum of the current control signals $I_0$, $L_1$ and $L_2$ is supplied to the drive control unit 20 as the control signal;

If $0.9V_{REF0} \leq V_{FB} < V_{REF0}$, the error amplifiers $OP_0$ with an amplification coefficient $K_0$ and $OP_{-1}$ with an amplification coefficient $K_{-1}$ are triggered simultaneously to output corresponding currents $I_0$ and $L_1$ respectively, and then the sum of the currents $I_0$ and $L_1$ is supplied to the drive control unit 20 as the control signal;

If $1.1V_{REF0} \leq V_{FB} < 1.2V_{REF0}$, the error amplifiers $OP_0$ with an amplification coefficient $K_0$ and $OP_{+1}$ with an amplification coefficient $K_{+1}$ are triggered simultaneously to output corresponding currents $I_0$ and $I_{+1}$ respectively, and then the sum of the currents $I_0$ and $I_{+1}$ is supplied to the drive control unit 20 as the control signal;

If $1.2V_{REF0} \leq V_{FB} \leq 1.3V_{REF0}$, the error amplifiers $OP_0$ with an amplification coefficient $K_0$, $OP_{+1}$ with an amplification coefficient $K_{+1}$ and $OP_{+2}$ with an amplification coefficient $K_{+2}$ are triggered simultaneously to output corresponding currents $I_0$, $I_{+1}$ and $I_{+2}$ respectively, and then the sum of the currents $I_0$, $I_{+1}$ and $I_{+2}$ is supplied to the drive control unit 20 as the control signal.

And so forth, the larger an absolute value of the difference between the feedback voltage $V_{FB}$ and the basis voltage $V_{REF0}$ is, the more the error amplifiers in the error amplification unit 10 to be triggered simultaneously. In other words, the larger the absolute value of the difference between the feedback voltage $V_{FB}$ and the basis voltage $V_{REF0}$ is, the more powerful the amplifying capability of the entire error amplification unit 10 to be, and the higher the amplification coefficient and amplification speed to be, such that the regulation capability thereof is more powerful.

As shown in FIG. 2, the drive control unit 20 is coupled to the error amplification unit 10 to receive the control signal therefrom, and to modulate a sawtooth-wave signal based on the control signal to output a PWM dimming signal with a corresponding duty cycle. The PWM dimming signal is loaded onto the output terminal of the power supply 300 to modulate a voltage signal $V_{in}$ output to the LED lamps 200 from the power supply 300, and a modulated voltage signal $V_{out}$ is loaded onto the LED lamps 200 to drive the LED lamps 200.

In the aforementioned embodiment, the sawtooth-wave signal may be provided by a sawtooth-wave signal generating unit 40. Since the configuration thereof pertains to the prior art, thus it is not described in detail herein.

In the aforementioned embodiment, the feedback voltage $V_{FB}$ received by the error amplification unit 10 is a voltage at one of the plurality of LED lamps 200. In view of this, a voltage selecting unit 50 is further needed to be arranged between the error amplification unit 10 and the LED lamps 200 for selecting, at one moment, the voltage at one certain lamp from the plurality of LED lamps 200 as the feedback voltage $V_{FB}$, and supplies the voltage to the error amplification unit 10. As it should be, the voltage selecting unit 50 may not need to be arranged if one error amplification unit 10 is provided for each of the LED lamps.

It can be known from above, the duty cycle of the PWM dimming signal is controlled via the control signal from the error amplification unit 10, while the operating voltage $V_{out}$ of the LED lamps 200 is regulated via the duty cycle of the PWM dimming signal, and the operating luminance of the LED lamps 200 is adjusted via the operating voltage $V_{out}$. Thus, the regulating capability of the error amplification unit 10 for the control signal output thereby may affect the response rate of the display device.

During operation of the aforementioned drive circuit 100, it is assumed that the voltage at one LED lamp is supplied, as the feedback voltage $V_{FB}$, to the error amplification unit 10 at a particular moment. If this LED lamp is under a stable operating state, then only the amplifier $OP_0$ with an amplification coefficient $K_0$ in the error amplification unit 10 is triggered to output a corresponding control signal $I_0$ to the drive control unit 20. Otherwise, if the operating state of the LED lamp is changed, then the feedback voltage $V_{FB}$ may instantaneously greater than the basis voltage $V_{REF0}$. In this condition, when the basis voltage is exceeded by 10%, the amplifier $OP_0$ with an amplification coefficient $K_0$ and the amplifier $OP_{+1}$ with an amplification coefficient $K_{+1}$ are triggered simultaneously. As a result, the amplifiers $OP_0$ and $OP_{+1}$ may operate together to rapidly adjust the control signal output to the drive control unit, and thereby a high response rate is provided. When the basis voltage is exceeded by 20%, the amplifiers $OP_0$ with an amplification coefficient $K_0$, $OP_{+1}$ with an amplification coefficient $K_{+1}$ and $OP_{+2}$ with an amplification coefficient $K_{+2}$ are triggered simultaneously. As a result, the amplifiers $OP_0$, $OP_{+1}$ and $OP_{+2}$ may operate together to rapidly adjust the control signal output to the drive control unit, and thereby a much higher response rate is provided. By mean of this, the technical effect of hierarchical adjustment for the response rate can be achieved. In summary, the backlight drive circuit provided in the present disclosure is capable of triggering the amplifiers of corresponding quantity with corresponding gains to participate in error adjustment based upon the difference between the loaded feedback voltage $V_{FB}$ and the predetermined basis voltage $V_{REF0}$, such that the error adjustment capability can be adjusted in term of different conditions, so as to adjust the response rate and realize differentiated processing.

In addition, the present disclosure further provides a liquid crystal display device including a backlight module, wherein backlight module is provided with the backlight drive circuit provided in the present disclosure to drive the backlights.

Although described above are the preferred specific embodiments of the present disclosure, the protection scope of the present disclosure is not limited thereto, e.g., voltage amplifiers may also be used to constitute the error amplification unit in the present disclosure. Any variations or alternatives readily conceivable by anyone familiar with this art within the disclosed technical scope of the present disclosure shall be covered within the protection scope of the present disclosure. Accordingly, the protection scope of the present disclosure shall be subject to the protection scope of the claims.

The invention claimed is:

1. A backlight drive circuit, comprising:

an error amplification unit configured to receive a feedback voltage from a backlight, and used for comparing the feedback voltage with a basis voltage, adjusting the amplification coefficient and amplification speed for the comparison result based on the magnitude of the comparison result, and outputting the amplification result as a control signal; and a drive control unit, which receives the control signal from the error amplification unit, and outputs, according to the control signal, a pulse width modulation dimming signal with a corresponding duty cycle to modulate a voltage signal output to the backlight from a power supply.

2. The backlight drive circuit of claim 1, wherein, the error amplification unit includes a plurality of error amplifiers, the comparison terminals of which are mutually coupled to receive the feedback voltage, the reference terminals of which receive different reference voltages, and the output terminals of which are mutually coupled to output the control signal, wherein the reference voltages each are a multiple of the basis voltage.

3. The backlight drive circuit of claim 2, wherein, the error amplifiers are distributed in a mirroring manner.

4. The backlight drive circuit of claim 3, wherein further comprising:

a reference voltage generating unit, which is coupled to the error amplification unit and supplies the reference voltages to the error amplification unit.

5. The backlight drive circuit of claim 2, wherein, the error amplifiers are current amplifiers.

6. The backlight drive circuit of claim 5, wherein further comprising:

a reference voltage generating unit, which is coupled to the error amplification unit and supplies the reference voltages to the error amplification unit.

7. The backlight drive circuit of claim 2, wherein further comprising:

a reference voltage generating unit, which is coupled to the error amplification unit and supplies the reference voltages to the error amplification unit.

8. The backlight drive circuit of claim 2, wherein, the error amplification unit includes error amplifiers $OP_i$, wherein i=−N . . . +N, and N is an integer greater or equal to 1, and wherein the reference voltage $V_{REFi}$ of the $i^{th}$ amplifier satisfies the following relationship with the basis voltage $V_{REF0}$:

$$V_{REFi}=(1+pxi)V_{REF0},$$

wherein p is an adjustment parameter greater than zero.

9. The backlight drive circuit of claim 8, wherein, the error amplifiers are distributed in a mirroring manner.

10. The backlight drive circuit of claim 9, wherein further comprising:

a reference voltage generating unit, which is coupled to the error amplification unit and supplies the reference voltages to the error amplification unit.

11. The backlight drive circuit of claim 8, wherein further comprising:

a reference voltage generating unit, which is coupled to the error amplification unit and supplies the reference voltages to the error amplification unit.

12. The backlight drive circuit of claim 8, wherein, the adjustment parameter p is equal to 0.1.

13. The backlight drive circuit of claim 12, wherein, the error amplifiers are distributed in a mirroring manner.

14. A liquid crystal display device including a display panel and a backlight module, wherein the backlight module includes a backlight drive circuit comprising:

an error amplification unit configured to receive a feedback voltage from a backlight, and used for comparing the feedback voltage with a basis voltage, adjusting the amplification coefficient and amplification speed for the comparison result based on the magnitude of the comparison result, and outputting the amplification result as a control signal; and a drive control unit, which receives the control signal from the error amplification unit, and outputs, according to the control signal, a pulse width modulation dimming signal with a corresponding duty cycle to modulate a voltage signal output to the backlight from a power supply.

15. The liquid crystal display device of claim 14, wherein, the error amplification unit includes a plurality of error amplifiers, the comparison terminals of which are mutually coupled to receive the feedback voltage, the reference terminals of which receive different reference voltages, and the output terminals of which are mutually coupled to output the control signal, wherein the reference voltages each are a multiple of the basis voltage.

16. The liquid crystal display device of claim 15, wherein, the error amplification unit includes error amplifiers $OP_i$, wherein i=−N . . . +N, and N is an integer greater or equal to 1, wherein the reference voltage $V_{RERi}$ of the $i^{th}$ amplifier satisfies the following relationship with the basis voltage $V_{REF0}$:

$$V_{REFi}=(1+pxi)V_{REF0},$$

wherein p is an adjustment parameter greater than zero.

17. The liquid crystal display device of claim 15, wherein, the error amplifiers are distributed in a mirroring manner.

18. A backlight drive method, comprising steps of:

a collection step of collecting a backlight feedback voltage;

a comparison step of comparing the backlight feedback voltage with a basis voltage;

an amplification step of adjusting the amplification coefficient and the amplification speed for the comparison result based on to the magnitude of the comparison result and outputting an amplification result as a control signal; and an output step of outputting, according to the control signal, a pulse width modulation dimming signal with a corresponding duty cycle to modulate a voltage signal output to the backlight from a power supply.

19. The backlight drive method of claim 18, wherein, in the amplification step, the amplifiers in corresponding quantity with corresponding gains are triggered according to the magnitude of the comparison result, so as to amplify the comparison result with different amplification coefficients and at different amplification speeds.

* * * * *